US009863140B2

(12) United States Patent
Dowd et al.

(10) Patent No.: US 9,863,140 B2
(45) Date of Patent: Jan. 9, 2018

(54) INSULATION RETENTION APPARATUS FOR USE WITH OVERHEAD STRUCTURAL BEAMS AND RELATED METHODS

(71) Applicants: Clinton Dowd, Goffstown, NH (US); Jonathan Schippani, Merrimack, NH (US)

(72) Inventors: Clinton Dowd, Goffstown, NH (US); Jonathan Schippani, Merrimack, NH (US)

( * ) Notice: Subject to any disclaimer, the term of this patent is extended or adjusted under 35 U.S.C. 154(b) by 107 days.

(21) Appl. No.: 14/849,959

(22) Filed: Sep. 10, 2015

(65) Prior Publication Data

US 2016/0083958 A1 Mar. 24, 2016

Related U.S. Application Data

(60) Provisional application No. 62/051,997, filed on Sep. 18, 2014.

(51) Int. Cl.

| | |
|---|---|
| ***E04B 1/74*** | (2006.01) |
| ***E04D 13/16*** | (2006.01) |
| ***E04B 1/76*** | (2006.01) |

(52) U.S. Cl.

CPC ..... *E04B 1/7654* (2013.01); *E04D 13/1625* (2013.01)

(58) Field of Classification Search

None

See application file for complete search history.

(56) References Cited

U.S. PATENT DOCUMENTS

| | | | | |
|---|---|---|---|---|
| 3,708,379 | A | 1/1973 | Flint | |
| 4,233,791 | A * | 11/1980 | Kuhl | E04B 1/66 156/71 |
| 4,405,341 | A | 9/1983 | Jaschek et al. | |
| 4,566,239 | A * | 1/1986 | Smigel | E04B 1/7666 24/460 |
| 4,996,803 | A | 3/1991 | Karrfalt et al. | |

(Continued)

FOREIGN PATENT DOCUMENTS

| | | | |
|---|---|---|---|
| DE | 2854476 A1 * | 7/1980 | E04B 1/7654 |
| WO | WO 9111567 A1 * | 8/1991 | E04B 1/7654 |

OTHER PUBLICATIONS

Machine translation of DE 2854476 A1, date pulled Dec. 26, 2016, p. 1-4.*

*Primary Examiner* — Elizabeth A Quast

(74) *Attorney, Agent, or Firm* — Hayes Soloway P.C.

(57) ABSTRACT

An insulation retention apparatus includes a non-gas-permeable plastic sheet. At least a first foam strip is affixed to the non-gas-permeable plastic sheet along a first side and at least a second foam strip is affixed to the non-gas-permeable plastic sheet along a second side, wherein the first side is substantially opposite the second side. An adhesive is positioned on each of the first and second foam strips, wherein the first foam strip is affixed to a first overhead structural beam with the adhesive and the second foam strip is affixed to a second overhead structural beam with the adhesive, wherein the first overhead structural beam is positioned spaced from the second overhead structural beam wherein the non-gas-permeable plastic sheet is extended therebetween, and wherein a quantity of insulation is retained on the non-gas-permeable plastic sheet.

20 Claims, 7 Drawing Sheets

(56) References Cited

U.S. PATENT DOCUMENTS 5,085,023 A * 2/1992 Duffy ..... E04B 7/024 52/407.4
5,421,133 A * 6/1995 Berdan, II ..... E04B 1/767 156/71
5,918,436 A 7/1999 Alderman
6,199,337 B1 * 3/2001 Colson ..... E04B 9/00 160/327
6,401,426 B1 * 6/2002 Alderman ..... E04D 15/06 52/745.06
6,857,238 B2 2/2005 Alderman
7,425,515 B2 9/2008 Fellinger et al.
7,785,685 B2 8/2010 Fay et al.
8,438,810 B2 5/2013 Robbins et al.
9,038,327 B1 * 5/2015 Harkins ..... E04D 5/145 52/165
9,605,426 B2 * 3/2017 Robins ..... E04B 1/7654
2002/0121061 A1 9/2002 Rippey
2003/0061777 A1 4/2003 Alderman
2004/0088939 A1 5/2004 Fay et al.
2004/0103608 A1 6/2004 Lionel
2004/0159063 A1 * 8/2004 Fligg ..... E04D 15/06 52/506.01
2004/0185210 A1 9/2004 Fay et al.
2004/0250490 A1 12/2004 Hall
2005/0000183 A1 1/2005 Fay et al.
2005/0276959 A1 12/2005 DeMasi
2007/0181704 A1 * 8/2007 Ernst ..... F24D 3/14 237/70
2007/0259155 A1 * 11/2007 Zupon ..... B32B 5/02 428/131
2008/0022620 A1 1/2008 Crowley
2010/0024325 A1 * 2/2010 Robbins ..... E04D 12/002 52/173.1
2011/0061311 A1 * 3/2011 Peng ..... E04D 13/1618 52/23
2011/0078973 A1 * 4/2011 Oberg ..... E04D 3/3603 52/582.1
2013/0047543 A1 * 2/2013 Musick ..... E04D 3/361 52/543
2015/0218803 A1 * 8/2015 Rockwell ..... E04D 13/1637 52/404.2
2015/0233110 A1 * 8/2015 Alter ..... E04B 1/7658 52/404.2

* cited by examiner

INSULATION RETENTION APPARATUS FOR USE WITH OVERHEAD STRUCTURAL BEAMS AND RELATED METHODS

CROSS REFERENCE TO RELATED APPLICATION

This application claims benefit of U.S. Provisional Application Ser. No. 62/051,997 entitled, "Insulation Retention Apparatus For Use With Overheard Structural Beams" filed Sep. 18, 2014, the entire disclosure of which is incorporated herein by reference.

FIELD OF THE DISCLOSURE

The present disclosure is generally related to insulation retention apparatuses and more particularly is related to insulation retention apparatus for use with overhead structural beams and related methods.

BACKGROUND OF THE DISCLOSURE

Insulation materials are conventionally placed in walls, ceilings, roofs, floors and other "wall structures" to thermally insulate a structure. The insulation material typically comprises fibrous blanket insulation, such as elongated blankets formed of fiberglass. The principle of the blanket insulation is to form dead air spaces that provide insulation against convection and conduction heat transfer. The blanket insulation can be formed in small "clumps" or particulate and can then be blown into spaces, such as into the attics of residential homes and other building structures. Blanket insulation can also be made into elongated blankets formed in a specific width and depth that is suitable for placement between parallel joists, studs, rafters, and other parallel support structures that are uniformly spaced apart. The elongated blanket, such as a fiberglass blanket, is cut to the desired length at the job site for placement between the parallel structures. Also, a sheet of facing material usually is applied to one broad surface of the blanket, with the facing material having overhanging edges extending beyond the sides of the blanket to form "tabs" that can be applied by the installer to studs, joists, etc. of the building structure to hold the blanket in place.

In commercial or industrial settings, such as in box stores with expansive drop ceilings, insulation for preventing overhead heat loss is often missing or severely lacking, namely due to the expense and difficulty of installing insulation within the expansive space. To gain greater energy efficiency, it is desirable to retrofit these ceilings with insulation, but doing so is often a time consuming and tedious job. For example, conventionally, these types of ceilings would be insulated using rigid foam board insulation that is cut to fit between rafters. Then, optionally, clumped insulation can be blown in above the rigid foam board insulation to increase the thermal efficiency of the insulation. The costs of installing such a system may be prohibitively high, due to the labor and time needed for installation. This prohibitive cost is especially true for structures with many wires, pipes, and ventilation conduits which are positioned above a drop ceiling—which a substantial majority of commercial and industrial buildings have. During installation, the rigid foam board insulation must be fitted around each structure, which requires significant cutting of the board insulation.

Furthermore, even when a conventional installation system is put in place, there still exists significant air flow through the cracks, gaps, and joints between the board insulation and the rafters. All of these spaces allow the flow of air between the spaces below the ceiling and the spaces above the ceiling, which allows cool air-conditioned air to leak out of the structure in the hot parts of the year and heated air to leak out of the structure in the colder parts of the year. The result is high inefficiencies in heating or cooling large buildings.

Thus, a heretofore unaddressed need exists in the industry to address the aforementioned deficiencies and inadequacies.

SUMMARY OF THE DISCLOSURE

Embodiments of the present disclosure provide an insulation retention apparatus and related systems and methods. Briefly described, in architecture, one embodiment of the apparatus, among others, can be implemented as follows. An insulation retention apparatus includes a non-gas-permeable plastic sheet. At least a first foam strip is affixed to the non-gas-permeable plastic sheet along a first side and at least a second foam strip is affixed to the non-gas-permeable plastic sheet along a second side, wherein the first side is substantially opposite the second side. An adhesive is positioned on each of the first and second foam strips, wherein the first foam strip is affixed to a first overhead structural beam with the adhesive and the second foam strip is affixed to a second overhead structural beam with the adhesive, wherein the first overhead structural beam is positioned spaced from the second overhead structural beam, wherein the non-gas-permeable plastic sheet is extended therebetween, and wherein a quantity of insulation is retained on the non-gas-permeable plastic sheet.

The present disclosure can also be viewed as providing a building structure air barrier system. Briefly described, in architecture, one embodiment of the system, among others, can be implemented as follows. An elongated sheet of non-gas-permeable material has at least a first foam strip affixed to the non-gas-permeable material along a first elongated side and at least a second foam strip affixed to the non-gas-permeable material along a second elongated side, wherein the first elongated side is substantially opposite the second elongated side. An adhesive is positioned on each of the first and second foam strips. A first overhead structural beam and a second overhead structural beam are incorporated into a building structure. The first overhead structural beam is positioned spaced from the second overhead structural beam. The first foam strip is affixed to the first overhead structural beam with the adhesive and the second foam strip is affixed to the second overhead structural beam with the adhesive, wherein the non-gas-permeable material is extended therebetween. A quantity of insulation is retained on the non-gas-permeable material.

The present disclosure can also be viewed as providing a method of creating an air barrier between a first and a second overhead structural beam within a building structure. In this regard, one embodiment of such a method, among others, can be broadly summarized by the following steps: providing a non-gas-permeable plastic sheet having at least a first foam strip affixed along a first side and at least a second foam strip affixed along a second side, wherein the first side is substantially opposite the second side; affixing the first foam strip to a first overhead structural beam with an adhesive; affixing the second foam strip to a second overhead structural beam with the adhesive, wherein the first overhead structural beam is positioned in a spaced, parallel orientation from the second overhead structural beam, wherein the non-gas-permeable plastic sheet is extended between the first and second overhead structural beams thereby creating an air barrier between spaces above and below the first and second overhead structural beams; and retaining a quantity of insulation on the non-gas-permeable plastic sheet.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
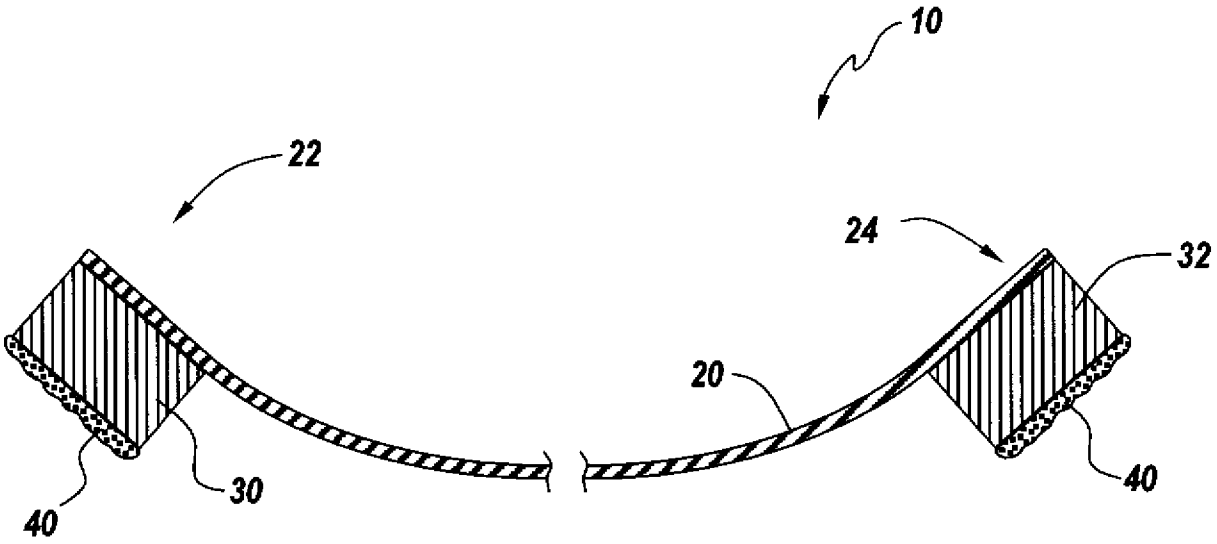
FIG. 1 is a cross-sectional illustration of an insulation retention apparatus, in accordance with a first exemplary embodiment of the present disclosure.

FIG. 1 is a cross-sectional illustration of an insulation retention apparatus 10, in accordance with a first exemplary embodiment of the present disclosure. The insulation retention apparatus 10, which may be referred to herein as 'apparatus 10', includes a non-gas-permeable plastic sheet 20. At least a first foam strip 30 is affixed to the non-gas-permeable plastic sheet 20 along a first side 22 and at least a second foam strip 32 is affixed to the non-gas-permeable plastic sheet 20 along a second side 24, wherein the first side 22 is substantially opposite the second side 24. An adhesive 40 is positioned on each of the first and second foam strips 30, 32.

Figure 2A:
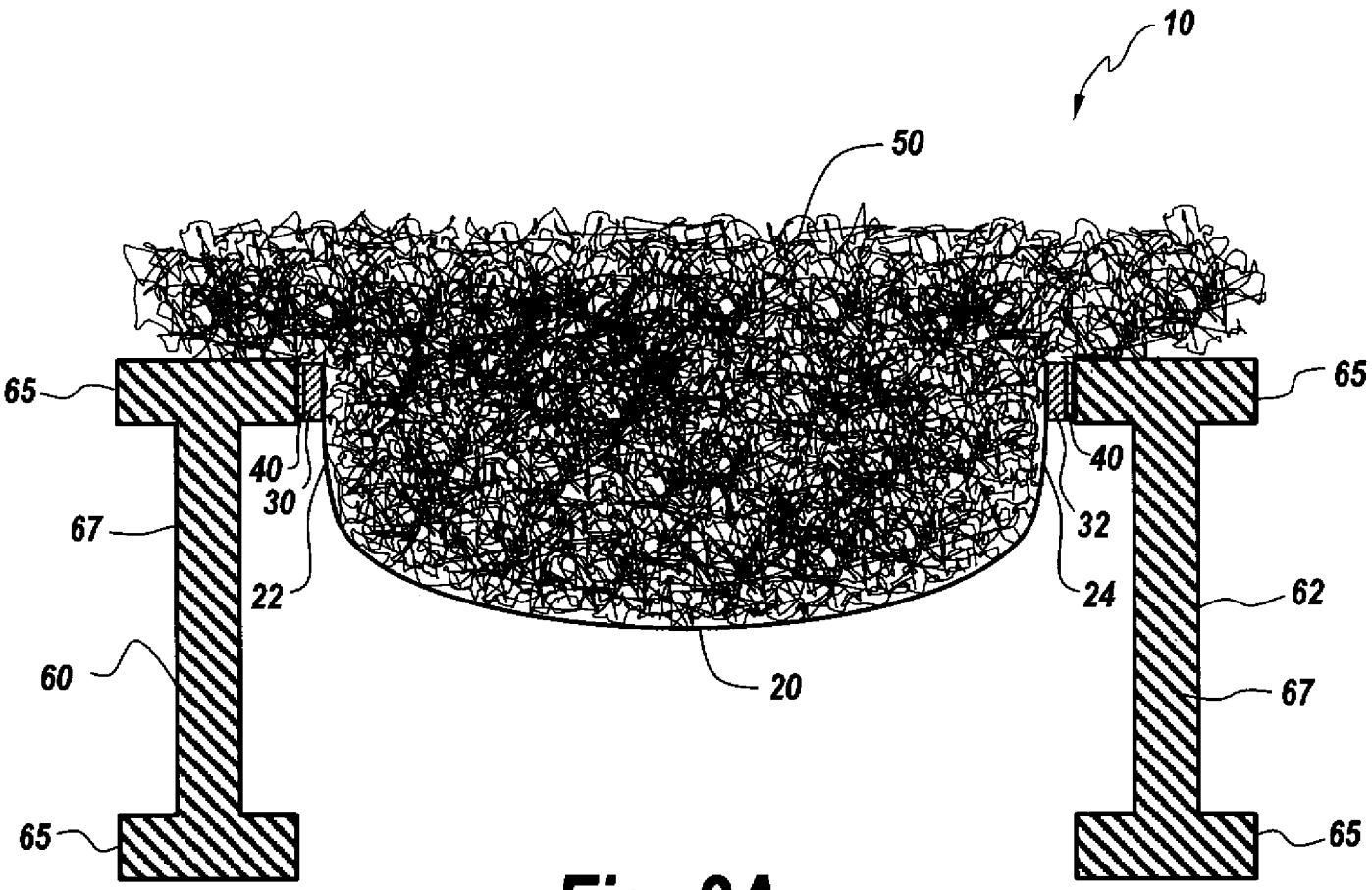
FIG. 2A is a cross-sectional illustration of the insulation retention apparatus of FIG. 1, in accordance with the first exemplary embodiment of the present disclosure.

FIG. 2A is a cross-sectional illustration of the insulation retention apparatus 10 of FIG. 1, in accordance with the first exemplary embodiment of the present disclosure. The apparatus 10 may be used for retaining a quantity of insulation 50 in a position between overhead structural beams, identified in FIG. 2A as a first overhead structural beam 60 and a second overhead structural beam 62. The first foam strip 30 may be affixed to a first overhead structural beam 60 with the adhesive 40 and the second foam strip 32 may be affixed to a second overhead structural beam 62 with the adhesive 40. The first overhead structural beam 60 is positioned spaced from the second overhead structural beam 62, such as trusses, rafters, ceiling joists, or similar structures are positioned spaced from one another. When connected between the first and second overhead structural beams 60, 62, the plastic sheet 20 may be extended between the first and second overhead structural beams 60, 62 and the quantity of insulation 50 may be retained on the plastic sheet 20.

In FIG. 2A, the first and second overhead structural beams 60, 62 are depicted as beams, but the first and second overhead structural beams 60, 62 may include any type of truss, rafter, ceiling joists, or other structural beam used in an overhead manner. In the I-beam construction, each I-beam may have two horizontal flange sections 65 and a vertical web section 67 connected therebetween. The plastic sheet 20 may be connected to various parts of the first and second overhead structural beams 60, 62. For example, the foam strips 30, 32 may be affixed to an elongated side of the first and second overhead structural beams 60, 62, i.e., the vertical web section 67. In one of many alternatives, as shown, the foam strips 30, 32 may be affixed to an upper member of the first and second overhead structural beams 60, 62, such as the flange sections 65, proximate to the top of the I-beam. Making the point of attachment towards the upper part of the first and second overhead structural beams 60, 62 may allow for the plastic sheet 20 to descend below the point of attachment, thereby allowing the plastic sheet 20 to carry the insulation 50 therein without descending past a bottom of the first and second overhead structural beams 60, 62. It may be more beneficial for the foam strips 30, 32 to connect to a vertical side or an upwards-facing horizontal surface The components of the apparatus 10 may include a variety of materials and devices, including many that are commonly used within the industry. For example, the plastic sheet 20 may include a sheeted material of polyethylene or similar material that is substantially flexible and pliable. The plastic sheet 20 may have a length that substantially exceeds a width, and a width dimension of the plastic sheet 20 may be larger than a dimension between the first and second overhead structural beams 60, 62. The first and second foam strips 30, 32 may include any type of foam material, including open or closed cell foam, so long as it is capable of being compressed. The adhesive 40 applied to the first and second foam strips 30, 32 may include any type of adhesive material, such as glue, which may be activated by a variety of catalysts. For example, the adhesive 40 may have a releasable, peel-away film positioned over it (such that the adhesive 40 is positioned between the foam strip 30, 32 and the releasable film) which, when removed from the adhesive 40, exposes it to the surrounding air to activate the adhesive 40. In one of many alternatives, the adhesive 40 could be activated by heat, light, such as UV light, or any other type of catalyst. The insulation material 50 used with the apparatus 10 may commonly include particulate or clumped insulation which is blown in above the apparatus 10 after it is installed in place between the overhead structural beams 60, 62. The insulation material 50 may occupy a position that is at least partially between the first and second overhead structural beams 60, 62 and at least partially above the first and second overhead structural beams 60, 62.

As is known in the industry, rafters and ceiling joists are conventionally positioned spaced from one another, such that there is a predetermined distance or gap between each rafter or joist from another. This span may include distances of 16", 24" 36" 48" or any other distance, the particular size of which is determined by the particular requirements of the structure or characteristics of the rafter or joist. To accommodate for efficient installation of the apparatus 10, the apparatus 10 may be provided as a rolled material having a preselected width (as measured between the first and second foam strips 30, 32) which substantially matches the gap between the rafters or joists to which the apparatus 10 will be installed. Further, the apparatus 10 may include an elongated length, which can be unrolled to whatever length is required during installation.

To install the apparatus 10, each of the first and second foam strips 30, 32 may be contacted to the overhead structural beam 60, 62 with the adhesive 40 positioned therebetween. A worker may move along the length of the overhead structural beam 60, 62 ensuring that each of the first and second foam strips 30, 32 is properly contacting its overhead structural beam 60, 62, to ensure that there are no gaps or spaces therebetween. When wires, pipes, ventilation structures, or other obstructions are positioned in the path of the apparatus 10, the plastic sheet 20 may be cut across its width at a position before the obstruction and restarted after the obstruction. Tape or a similar fastening device may be used to connect the two edges of the plastic sheet 20 together, thereby ensuring that the air barrier is maintained even around the obstruction.

After a length of the apparatus 10 is installed, the particulate insulating material 50 may be blown in to a position between the overhead structural beams 60, 62 and above the plastic sheet 20. As is shown in FIG. 2A, the plastic sheet 20 may have a width that is greater than the gap between the first and second overhead structural beams 60, 62, thereby allowing a middle of the plastic sheet 20 to descend below a point of contact between each of the first and second foam strips 30, 32 and the overhead structural beams 60, 62. This descended portion of the plastic sheet 20 may allow the insulating material 50 to be retained with adequate coverage between the overhead structural beams 60, 62. For example, the descended portion of the plastic sheet 20 may sag to an approximate half-way point on the overhead structural beams 60, 62. Once the particulate insulating material 50 is positioned above the apparatus 10, it may fully occupy the plastic sheet 20 and rise approximately 6-18" above the top of the overhead structural beams 60, 62, thereby providing a continuous span of insulating material 50 across all overhead structural beams 60, 62.

The use of the apparatus 10 provides for an easier and more cost-effective solution to retrofitting ceilings with rafters and joists, and also provides an enhanced thermal barrier. Specifically, the use of the plastic sheet 20 and the adhesive 40 connected to the overhead structural beams 60, 62 maintains a sealed air barrier which substantially aids in preventing the loss of heated air, in comparison to the conventional rigid board insulation which has gaps and cracks that allow air movement. Use of the apparatus 10 allows for substantially easier installation over conventional techniques, since the apparatus 10 is capable of quickly being positioned between the overhead structural beams 60, 62 and retained therein.

Figure 2B:
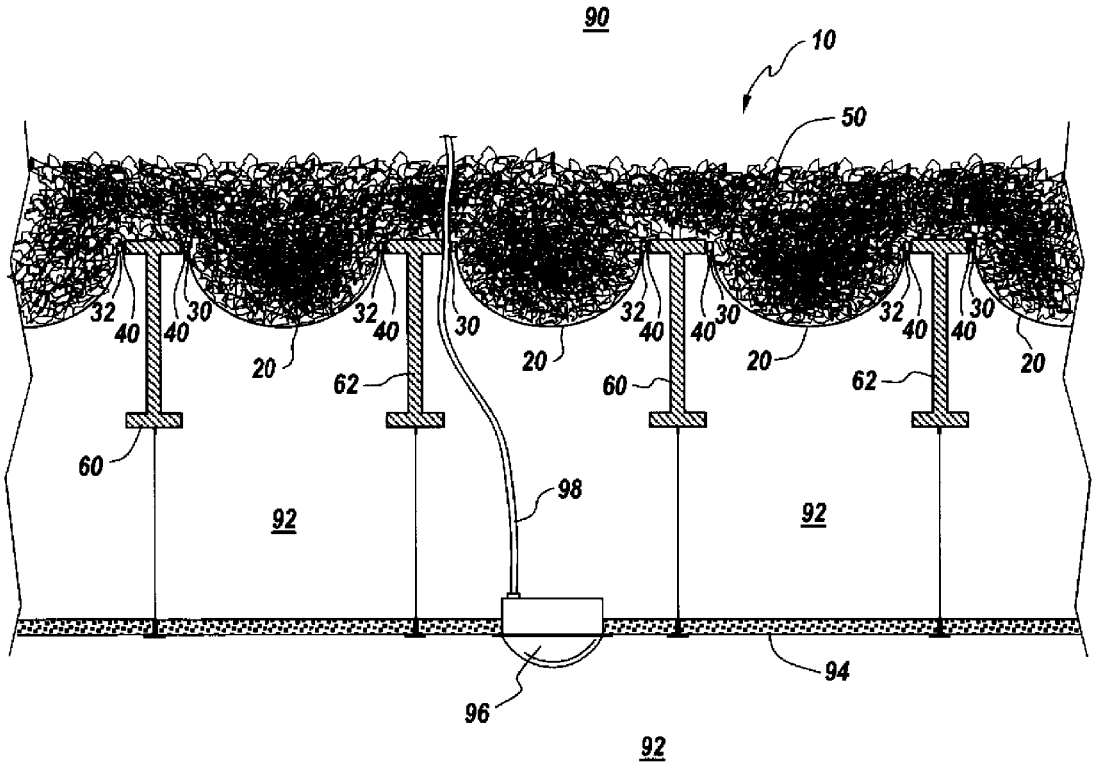
FIG. 2B is a cross-sectional illustration of the insulation retention apparatus of FIG. 1 used with a plurality of overhead structural beams, in accordance with the first exemplary embodiment of the present disclosure.

FIG. 2B is a cross-sectional illustration of the insulation retention apparatus of FIG. 1 used with a plurality of overhead structural beams 60, 62, in accordance with the first exemplary embodiment of the present disclosure. Relative to FIGS. 2A-2B, the plastic sheet 20 may prevent all quantities of gas, air, or other materials from moving through the sheet. As a result, when the plastic sheet 20 is positioned affixed to the overhead structural beams 60, 62 with the foam strips 30, 32 and adhesive 40, virtually all air movement between an upper area 90 or a position above the plastic sheet 20 and a lower area 92 or a position below the plastic sheet 20 may be eliminated. This ability of the apparatus 10 to prevent movement of gas, air, and materials may be referred to as an air barrier. Affixing the plastic sheet 20 directly to the overhead structural beam 60, 62 without use of a foam strip 30, 32 would not be capable of creating the air barrier.

As shown in FIG. 2B, the lower area 92 may include the area below the overhead structural beams 60, 62, which may be positioned below or above a drop ceiling 94 that is suspended from the overhead structural beams 60, 62. The wiring, piping, or other feeds to utility fixtures, such as a lighting fixture 96 which may be present in the drop ceiling 94, may be positioned through the plastic sheet 20. For example, a wire 98 to a lighting fixture 96 may be snaked between the apparatus 10 and the side of the overhead structural beams 60, 62, such that the adhesive 40 and foam strip 30, 32 seal around the wire 98. In one of many alternatives, the wire 98 may be positioned directly through the plastic sheet 20 itself, where tape or another sealant is used to seal around the wire 98. The apparatus 10 may also be installed with other fixtures, such as HVAC ducts or piping, low-voltage wiring, or any other utility fixture, in the same manner.

Figure 3B:
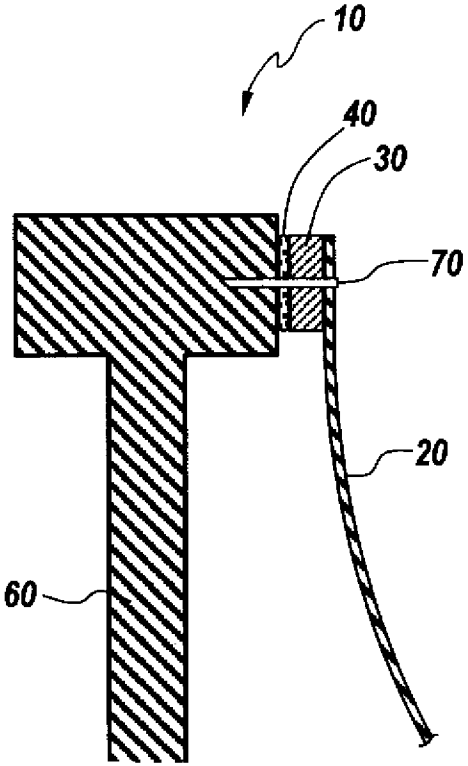
FIGS. 3A-3B are cross-sectional illustrations of the insulation retention apparatus of FIG. 1, in accordance with the first exemplary embodiment of the present disclosure.
Figure 3A:
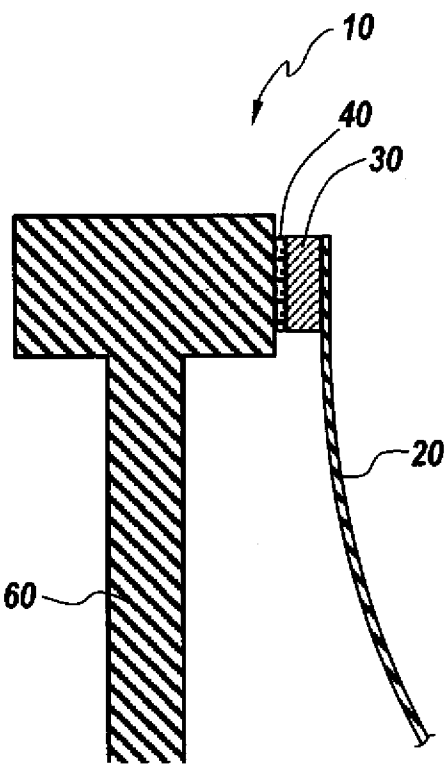

FIGS. 3A-3B are cross-sectional illustrations of the insulation retention apparatus 10 of FIG. 1, in accordance with the first exemplary embodiment of the present disclosure. As is shown in FIG. 3A, the adhesive 40 may retain the foam strip 30 affixed to the plastic sheet 20 successfully on the overhead structural beam 60. However, to increase the durability of the apparatus 10, a mechanical fastener 70 may be used in combination with the adhesive 40 to retain the foam strip 30 affixed to the plastic sheet 20 successfully on the overhead structural beam 60. As is shown in FIG. 3B, the mechanical fastener 70 may include a staple, nail, screw, or other threaded or non-threaded drivable fastener which can be posited through the plastic sheet 20, the foam strip 30, and the adhesive 40 and into the overhead structural beam 60. While the adhesive 40 may provide short-term adhesion between the apparatus 10 and the overhead structural beam 60, the mechanical fastener 70 may ensure long-term adhesion.

Figure 4:
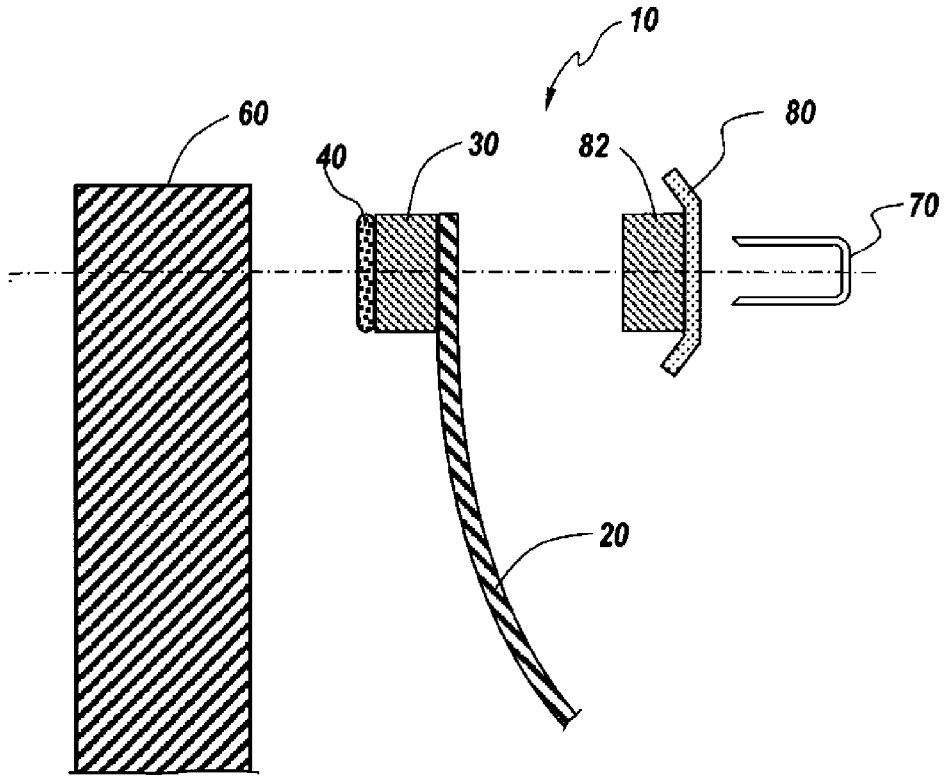
FIG. 4 is an exploded view, cross-sectional illustration of the insulation retention apparatus of FIG. 1 in use with a retaining clip, in accordance with the first exemplary embodiment of the present disclosure.
Figure 5:
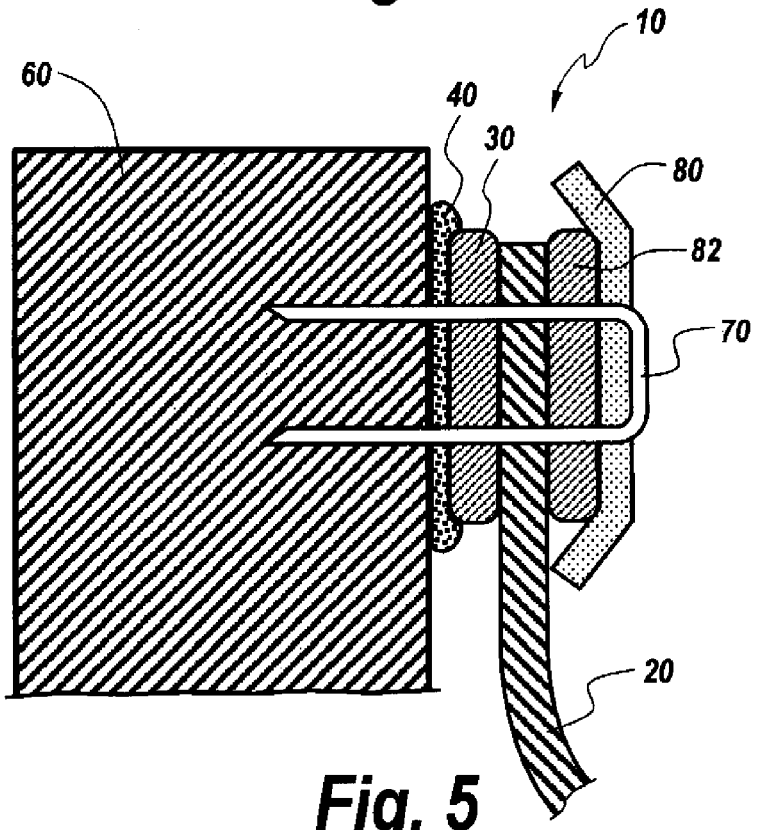
FIG. 5 is a cross-sectional illustration of the insulation retention apparatus in use with a retaining clip of FIG. 4, in accordance with the first exemplary embodiment of the present disclosure.

FIG. 4 is an exploded view, cross-sectional illustration of the insulation retention apparatus 10 of FIG. 1 in use with a retaining clip 80, in accordance with the first exemplary embodiment of the present disclosure. FIG. 5 is a cross-sectional illustration of the insulation retention apparatus 10 in use with a retaining clip 80 of FIG. 4, in accordance with the first exemplary embodiment of the present disclosure. While the mechanical fastener 70 of FIG. 3B provides additional support in keeping the apparatus 10 retained to the overhead structural beam 60, a retaining clip 80 may also be used to provide further support. In particular, the retaining clip 80 may aid in providing a constant pressure between the plastic sheet 20, the foam strip 30, and the overhead structural beam 60 to provide an improved air barrier. The retaining clip 80 can also aid in the strength of holding the plastic sheet 20 in place. As is shown in FIG. 4, the retaining clip 80 may include a substantially rigid material having a quantity of foam 82 affixed thereto. The retaining clip 80 may be composed of plastic, rubber, or similar material, and may be extruded into an elongated length, such that it can be applied to the length of the foam strip 30.

In FIGS. 4-5, it can be seen that the retaining clip 80 is shaped with indented edges, allowing the retaining clip 80 to compress the layers of foam 82, 30, and the adhesive 40 to the overhead structural beam 60. The foam 82 may ensure that there is sufficient and even pressure on the plastic sheet 20 and the foam strip 30 and adhesive 40, which further ensures that there is substantially no air movement between the connection of the apparatus 10 and the overhead structural beam 60. As is shown in FIG. 5, the mechanical fastener 70 may be applied through the retaining clip 80, foam 82, plastic sheet 20, foam strip 30, and adhesive 40, such that it is affixed into the overhead structural beam 60. The mechanical fastener 70 may compress the foam 82 and the foam strip 30 against the overhead structural beam 60 and retain them in place in a compressed position.

Relative to FIGS. 1-5, the apparatus 10 is illustrated as being applied to the side of the overhead structural beam 60, such that the joint between the adhesive 40 and the overhead structural beam 60 is substantially vertical. However, it is noted that the apparatus 10 may be applied to other locations of the overhead structural beam 60, such as the top, the lip of an I-beam or T-beam, or another area. For example, it may be common to apply the adhesive 40 to a horizontal face of the overhead structural beam 60 that substantially faces upwards. Securing the apparatus 10 on a horizontal face of the overhead structural beam 60 may provide for enhanced adhesion between the apparatus 10 and the overhead structural beam 60, since the force of the plastic sheet 20 pulling on the adhesive 40 due to the weight of the insulation 50 may be substantially parallel to the adhesive joint formed between the adhesive 40 and the overhead structural beam 60.

Figure 6:
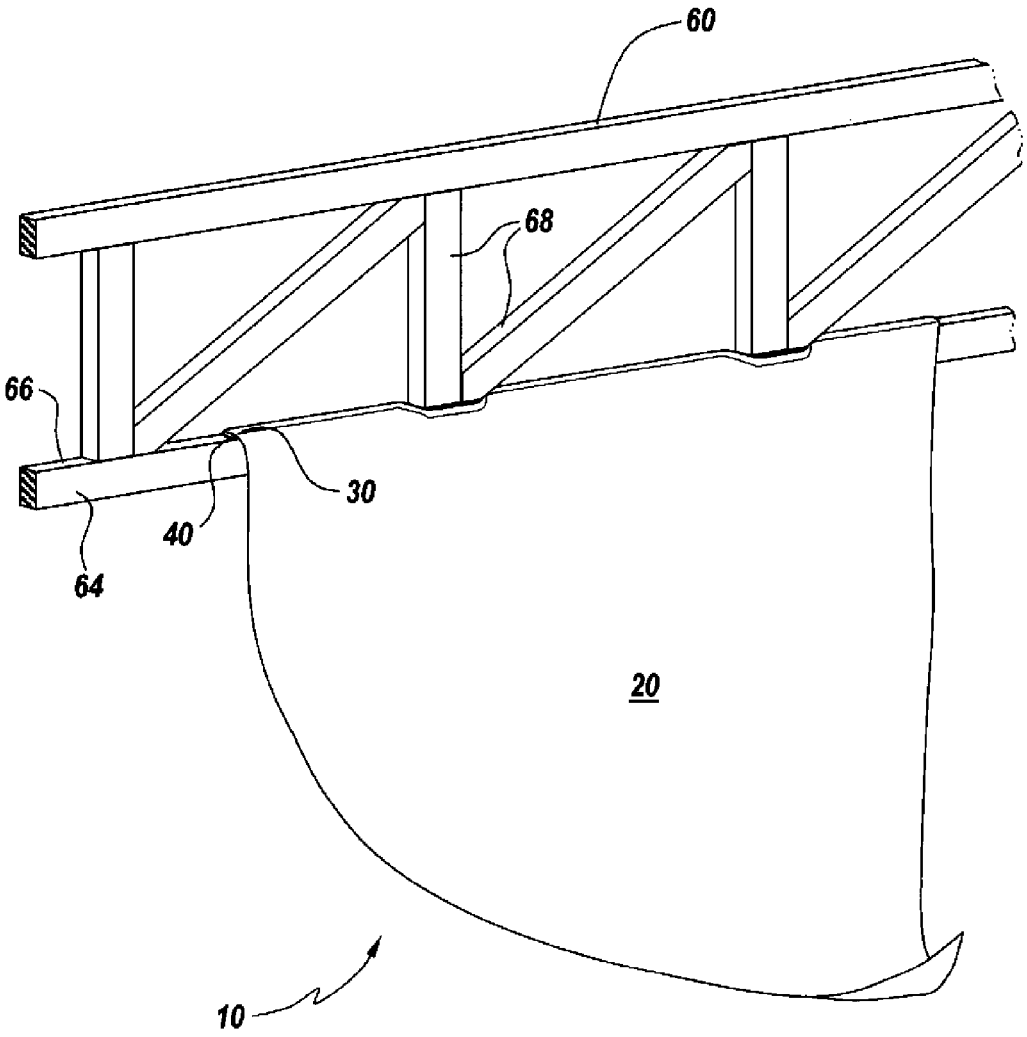
FIG. 6 is a partial cross-sectional illustration of the insulation retention apparatus of FIG. 1, in accordance with the first exemplary embodiment of the present disclosure.

FIG. 6 is a partial cross-sectional illustration of the insulation retention apparatus 10 of FIG. 1, in accordance with the first exemplary embodiment of the present disclosure. As is shown in FIG. 6, the overhead structural beam 60 may include a truss, which has triangular units constructed with connecting members 68 whose ends are connected at joints. When the apparatus 10 is applied to an overhead structural beam 60 having a truss design, the foam strip 30 with adhesive 40 may be applied to both an upwards-facing horizontal face 66 of the overhead structural beam 60 and a vertical face 64 of the overhead structural beam 60, as is shown in FIG. 6. In particular, the flexibility of the plastic sheet 20, the foam strip 30, and the adhesive 40 may allow the edge of the apparatus 10 to be positioned on the horizontal face 66 for a length of the overhead structural beam 60, and when a connecting member 68 is present, the edge of the apparatus 10 may be moved to the vertical face 64 of the overhead structural beam 60, and then back to the horizontal face 66, accordingly. Even when being affixed to both the vertical and horizontal faces 64, 66 of the overhead structural beam 60, the apparatus 10 may retain an air-tight seal to the overhead structural beam 60.

Figure 7:
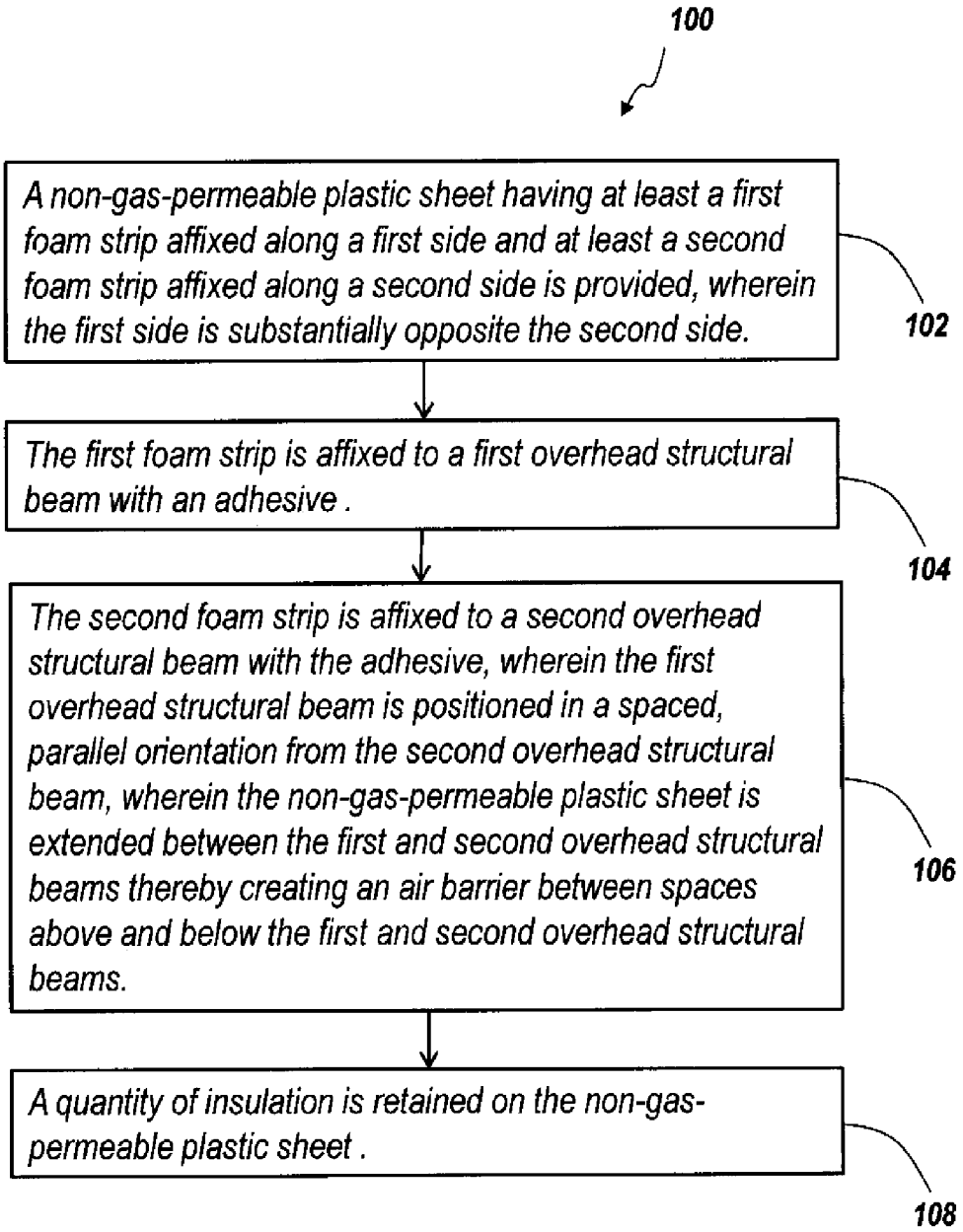
FIG. 7 is a flowchart illustrating a method of applying an insulation retention apparatus to an overhead truss, in accordance with the first exemplary embodiment of the disclosure.

FIG. 7 is a flowchart 100 illustrating a method of creating an air barrier between a first and a second overhead structural beam within a building structure, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a non-gas-permeable plastic sheet having at least a first foam strip affixed along a first side and at least a second foam strip affixed along a second side is provided, wherein the first side is substantially opposite the second side. The first foam strip is affixed to a first overhead structural beam with an adhesive (block 104). The second foam strip is affixed to a second overhead structural beam with the adhesive, wherein the first overhead structural beam is positioned in a spaced, parallel orientation from the second overhead structural beam, wherein the non-gas-permeable plastic sheet is extended between the first and second overhead structural beams thereby creating an air barrier between spaces above and below the first and second overhead structural beams (block 106). A quantity of insulation is retained on the non-gas-permeable plastic sheet (block 108).

The method may include any number of additional steps, processes, or functions, including any that are disclosed relative to FIGS. 1-6. For example, the first overhead structural member may further comprise a first truss with connecting members, where the first foam strip is affixed to at least a horizontal face and an adjacent vertical face of the first truss, wherein the connecting members are positioned on the horizontal face. The non-gas-permeable plastic sheet may be affixed to one of the first and second overhead structural members with a mechanical fastener. The mechanical fastener may be positioned through one of the first and second foam strips and the adhesive. Furthermore, a substantially rigid retaining clip may be positioned against the non-gas-permeable plastic sheet with the mechanical fastener to assist with retaining the non-gas-permeable plastic sheet to the overhead structural member.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An insulation retention apparatus comprising:

a non-gas-permeable plastic sheet;

at least a first flexible foam strip affixed to the non-gas-permeable plastic sheet along a first side and at least a second flexible foam strip affixed to the non-gas-permeable plastic sheet along a second side, wherein the first side is substantially opposite the second side; and an adhesive positioned on each of the first and second flexible foam strips, wherein the first flexible foam strip is affixed to a first overhead structural beam with the adhesive and the second flexible foam strip is affixed to a second overhead structural beam with the adhesive, wherein the first overhead structural beam is positioned spaced from the second overhead structural beam wherein the non-gas-permeable plastic sheet is extended therebetween, and wherein a quantity of insulation is retained on the non-gas-permeable plastic sheet, and wherein at least one of the first and second overhead structural beams further comprise a truss having a top beam and a bottom beam connected together with connecting members, wherein the first flexible foam strip is adhesively connected to a substantially upwards-facing face of the bottom beam and routed around connecting members connected to the substantially upwards-facing face of the bottom beam while maintaining a continuous air seal to the bottom beam.

2. The insulation retention apparatus of claim 1, wherein the non-gas-permeable plastic sheet has a length that substantially exceeds a width, wherein a width dimension of the non-gas-permeable plastic sheet is larger than a dimension between the first overhead structural beam and the second overhead structural beam.

3. The insulation retention apparatus of claim 1, wherein in a position between the first overhead structural beam and the second overhead structural beam, the non-gas-permeable plastic sheet, the first and second flexible foam strips, and the adhesive form an air-tight seal separating an upper area from a lower area, wherein the upper area is formed above the first overhead structural beam and the second overhead structural beam and a lower area is formed below the first overhead structural beam and the second overhead structural beam.

4. The insulation retention apparatus of claim 1, wherein the first overhead structural beam and the second overhead structural beam further comprise at least one of: a truss, a rafter, and a ceiling joist.

5. The insulation retention apparatus of claim 1, wherein the first flexible foam strip is affixed to an elongated side of the first overhead structural beam with the adhesive and the second flexible foam strip is affixed to an elongated side of the second overhead structural beam with the adhesive.

6. The insulation retention apparatus of claim 1, wherein the first and second overhead structural beams further comprise first and second I-beams, respectively, wherein the first flexible foam strip is affixed to an elongated side of the first I-beam on an upper member of the first I-beam with the adhesive and the second flexible foam strip is affixed to an elongated side of the second I-beam on an upper member of the second I-beam with the adhesive.

7. The insulation retention apparatus of claim 6, wherein the upper member of the first and second I-beams further comprises a horizontal flange of the first and second I-beams.

8. The insulation retention apparatus of claim 1, wherein the quantity of insulation is positioned at least partially between the first and second overhead structural beams and at least partially above the first and second overhead structural beams.

9. The insulation retention apparatus of claim 1, wherein a middle portion of the non-gas-permeable plastic sheet is positioned at a descended point relative to a point of contact between the adhesive positioned on each of the first and second flexible foam strips and the first and second overhead structural members, respectively.

10. The insulation retention apparatus of claim 1, further comprising a mechanical fastener affixing the non-gas-permeable plastic sheet to one of the first and second overhead structural members, wherein the mechanical fastener is positioned through one of the first and second flexible foam strips and the adhesive.

11. The insulation retention apparatus of claim 10, further comprising a substantially rigid retaining clip, wherein the mechanical fastener retains the substantially rigid retaining clip against the non-gas-permeable plastic sheet.

12. The insulation retention apparatus of claim 11, wherein the substantially rigid retaining clip has a quantity of foam positioned on a side thereof.

13. The insulation retention apparatus of claim 11, wherein the mechanical fastener and the substantially rigid retaining clip compress at least one first and second flexible foam strip, through which the mechanical fastener is positioned, against a corresponding one of the first and second overhead structural member.

14. The insulation retention apparatus of claim 1, wherein the non-vertical face of the first truss further comprise a horizontal face, wherein the horizontal face is positioned adjacent to the vertical face, wherein the connecting members are positioned on the horizontal face.

15. The insulation retention apparatus of claim 1, wherein the first flexible foam strip being routed around connecting members further comprises the first flexible foam strip being positioned along a substantially sideways-facing face of the bottom beam at a positioned along the bottom beam corresponding to a location of at least one of the connecting members.

16. A method of creating an air barrier between a first and a second overhead structural beam within a building structure, the method comprising the steps of:

providing a non-gas-permeable plastic sheet having at least a first flexible foam strip affixed along a first side and at least a second flexible foam strip affixed along a second side, wherein the first side is substantially opposite the second side;

affixing the first flexible foam strip to a first overhead structural beam with an adhesive;

affixing the second flexible foam strip to a second overhead structural beam with the adhesive, wherein the first overhead structural beam is positioned in a spaced, parallel orientation from the second overhead structural beam, wherein the non-gas-permeable plastic sheet is extended between the first and second overhead structural beams thereby creating an air barrier between spaces above and below the first and second overhead structural beams and wherein at least one of the first and second overhead structural beams further comprise a truss having a top beam and a bottom beam connected together with connecting members, wherein the first flexible foam strip is adhesively connected to a substantially upwards-facing face of the bottom beam and routed around connecting members connected to the substantially upwards-facing face of the bottom beam while maintaining a continuous air seal to the bottom beam; and retaining a quantity of insulation on the non-gas-permeable plastic sheet.

17. The method of claim 16, wherein the first overhead structural member further comprises a first truss with connecting members, wherein affixing the first flexible foam strip further comprises affixing the first flexible foam strip to at least a horizontal face and an adjacent vertical face of the first truss, wherein the connecting members are positioned on the horizontal face.

18. The method of claim 16, further comprising affixing the non-gas-permeable plastic sheet to one of the first and second overhead structural members with a mechanical fastener, wherein the mechanical fastener is positioned through one of the first and second flexible foam strips and the adhesive.

19. The method of claim 18, further comprising retaining a substantially rigid retaining clip against the non-gas-permeable plastic sheet with the mechanical fastener.

20. A building structure air barrier system comprising:

an elongated sheet of non-gas-permeable material;

at least a first flexible foam strip affixed to the non-gas-permeable material along a first elongated side and at least a second flexible foam strip affixed to the non gas-permeable material along a second elongated side, wherein the first elongated side is substantially opposite the second elongated side;

an adhesive positioned on each of the first and second flexible foam strips; and a first overhead structural beam and a second overhead structural beam incorporated into a building structure, wherein the first overhead structural beam is positioned spaced from the second overhead structural beam, wherein the first flexible foam strip is affixed to the first overhead structural beam with the adhesive and the second flexible foam strip is affixed to the second overhead structural beam with the adhesive, wherein the non-gas-permeable material is extended therebetween, and wherein a quantity of insulation is retained on the non-gas-permeable material, and wherein at least one of the first and second overhead structural beams further comprise a truss having a top beam and a bottom beam connected together with connecting members, wherein the first flexible foam strip is adhesively connected to a substantially upwards-facing face of the bottom beam and routed around connecting members connected to the substantially upwards-facing face of the bottom beam while maintaining a continuous air seal to the bottom beam.

* * * * *